United States Patent [19]

Bowen, Jr., deceased et al.

[11] Patent Number: 4,513,789

[45] Date of Patent: Apr. 30, 1985

[54] JACQUARD HARNESS ATTACHMENT MECHANISM

[75] Inventors: John C. Bowen, Jr., deceased, late of Morris County, N.J.; by Wiley C. Bowen, executrix, Lakewood, Ohio

[73] Assignee: The Baxter Corporation, Hawthorne, N.J.

[21] Appl. No.: 505,083

[22] Filed: Jun. 13, 1983

[51] Int. Cl.[3] ..... D03C 3/00; D03C 3/40; D03C 3/44

[52] U.S. Cl. ..... 139/85; 139/59; 139/90

[58] Field of Search ..... 139/85, 90, 89, 59

[56] References Cited

U.S. PATENT DOCUMENTS

| | | |
|---|---|---|
| 1,378,567 | 5/1921 | Siesholtz . |
| 3,885,598 | 5/1975 | Vogelbacher . |
| 4,034,782 | 7/1977 | Bucher . |

FOREIGN PATENT DOCUMENTS

| | | | |
|---|---|---|---|
| 2128069 | 2/1973 | Fed. Rep. of Germany | 139/85 |
| 2651057 | 5/1978 | Fed. Rep. of Germany . | |
| 2828140 | 1/1980 | Fed. Rep. of Germany | 139/90 |
| 257737 | 9/1926 | United Kingdom | 139/90 |
| 956904 | 4/1964 | United Kingdom | 139/85 |

*Primary Examiner*—James Kee Chi

*Attorney, Agent, or Firm*—Gottlieb, Rackman & Reisman

[57] ABSTRACT

An arrangement is disclosed for stabilizing and reinforcing the connection between the resilient hold-down control springs and their underlying couplings in a Jacquard loom. The junction between two portions of the spring is strengthened by using a flared-out arrangement beneath an aligning comber board through which the springs pass in a vertical orientation. In this manner, the connected heddle/spring is maintained in a reliable axial position and the spring is able to function in its resilient holding-down capacity by a technique which generates reduced stress at the key point where the spring is retained.

5 Claims, 3 Drawing Figures

Figure 2:
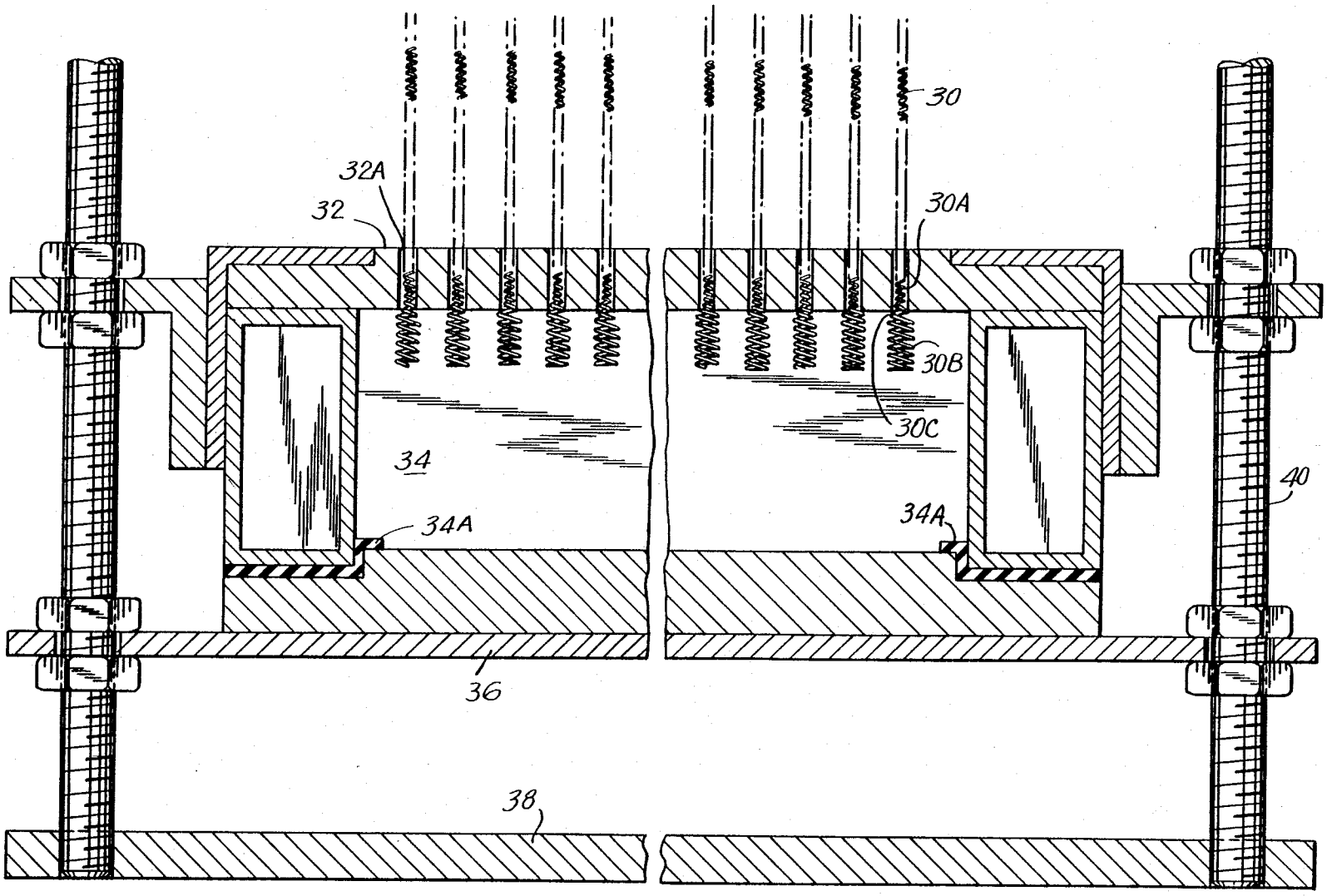

FIG. 1
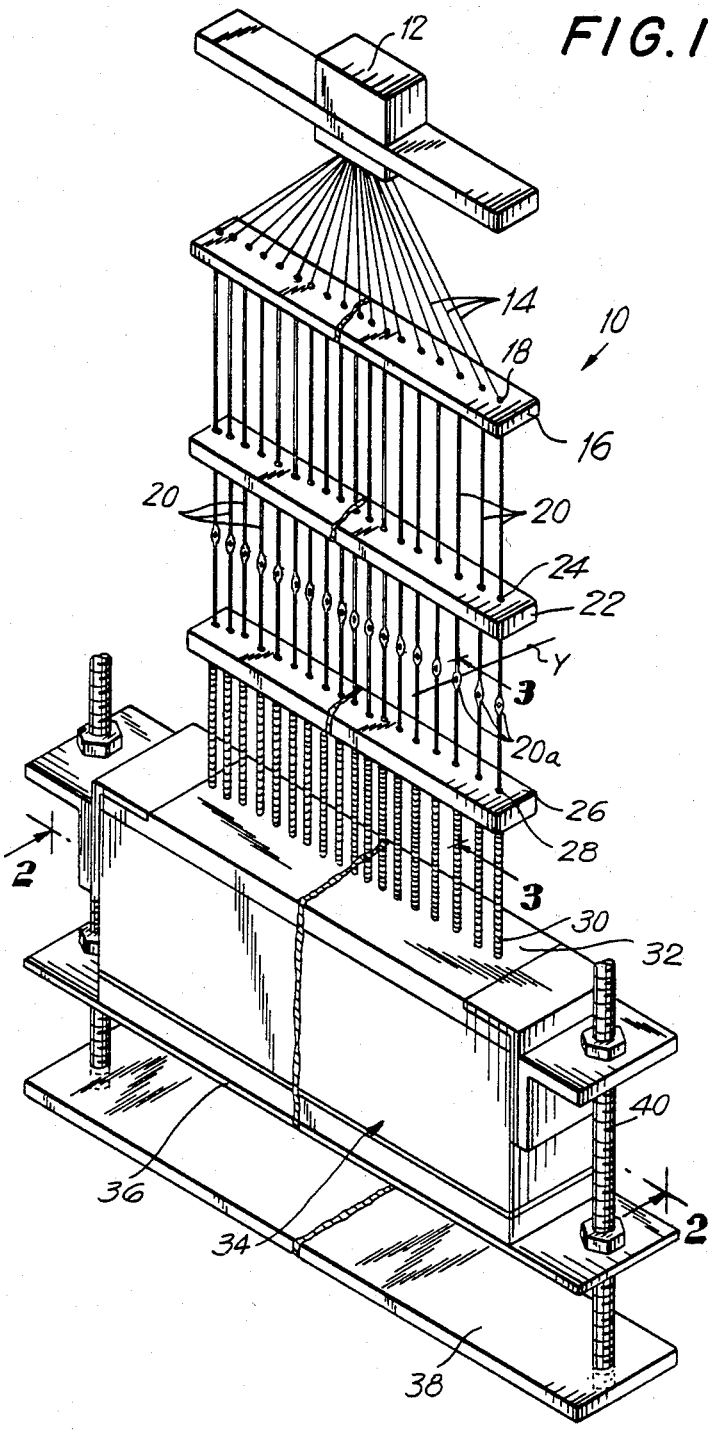
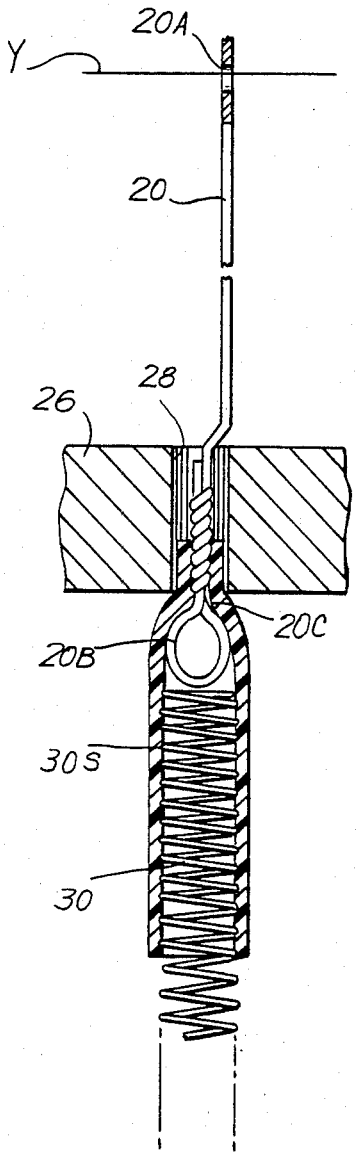
FIG. 3

JACQUARD HARNESS ATTACHMENT MECHANISM

DESCRIPTION

This invention relates to accessories for Jacquard looms, and in particular to a device for reinforcing the hold-down arrangement in the harness for such a loom.

In the evolution of weaving, particularly with respect to more complex designs, the Jacquard loom has continued to maintain an important position in this field. Because of its unique ability to translate intricate patterns from artwork to programs, generally by means of perforated cards, and then into movement of batteries of needles which are responsive to the cards' perforations, the Jacquard loom is often relied on for special design effect in the apparel, domestics, upholstery and related fields.

The basic design parameters and structures of Jacquard looms have been well known and established for many years, with changes only occurring in some of the peripheral aspects of the equipment. For example, the heddles, which raise and lower the warp yarns in accordance with the patterns punched in the perforated cards above them, had traditionally been returned to their normal positions by the gravity action of weighted "lingoes". Subsequently, the lingoes were replaced by synthetic fibers such as are available under the registered trademark LYCRA, which were resilient, and caused the heedles to be pulled downward by a spring-like action. Thereafter, technology dictated the replacement of the LYCRA strands by thin stainless steel springs, which acted very much like the LYCRA strands, but which were more reliable and which generated no adverse side effects, such as fiber dust.

But even with the use of these steel springs, the arrangement has not proved to be as satisfactory as might have been desired. Because of the stresses placed on the connection between the springs, and the holding-down mechanism for the springs, it is not uncommon for a spring to pull loose, thus removing tension from the heddle and preventing one or more yarns in the Jacquard pattern from returning to their normal positions. Not only does this interrupt the weaving process, but it leads to potential errors in the ultimately produced pattern. When confronted with this problem, the prior art devised various techniques, including forming a hook-like member from the spring itself in order to provide an integral connection between the spring and the base of the loom. However, this arrangement proved to be equally unsatisfactory. In a field where the emphasis is on quality workmanship and superior detailing, such errors could not be tolerated.

It is therefore an object of this invention to obviate one or more of the aforesaid difficulties.

It is another object of this invention to reinforce the connection between the spring-type lingoes and their hold-down devices in a Jacquard loom.

It is a further object of this invention to utilize a particular flared connection at the hold-down end of the springs to enhance the operation of a Jacquard loom.

Additional objects and advantages of this invention will become apparent when considered in conjunction with one particular illustrative embodiment of the invention, wherein a Jacquard loom is generally disclosed in conjunction with the two principal aspects of the present invention, namely a "comber board" hold-down structure and a flared connection in the spring element which effectively holds the heddle of the Jacquard loom in its normal position. The main components of the Jacquard loom are conventional and will not be discussed or disclosed in any great detail. It is sufficient for purposes of this invention description to note that the "head" of the Jacquard loom is contained in a superstructure in which the program, generally in the form of perforated cards, can be fed to the tops of the batteries of needles which are connected to the heddles via a comparable network of strings. Each needle controls a string, which is in turn connected to the top of a corresponding heddle. The movement of the needles is directly controlled by the perforations in the cards, i.e., the needles can move through perforations where they exist, but where there are no such perforations, the needles will not drop through and accordingly, those particular heddles will not move. The heddles which do move, however, lift the corresponding warp yarns which are threaded through the holes in the center of the heddle. In this manner, the variegated pattern for which Jacquard looms are known can be generated.

In the vertical orientation for the network of strings, needles, heddles and springs (in that order), problems have arisen with respect to both the alignment thereof and the particular connection between the springs and their holding-down structure. This invention is addressed to both of those problems. With regard to the alignment difficulties of the prior art, there had heretofore been little attention paid to what happens to the lingoes, lycra or springs beneath the connection point with the heddles. The present invention rectifies this problem by providing a comber board arrangement in which a plurality of holes is provided through which the hold-down springs can pass. First of all, this provides a direct longitudinal path for the springs to pass through, aligning the springs in part with the overhanging Jacquard harness board. At the same time, the under surface of the comber board provides a base surface for the important low stress flared connection which is the other aspect of this invention.

As the springs, connected at an upper point to the heddles, pass through the perforated comber board, each spring is provided with an enlarged or flared connection at the undersurface of the comber board element. The flaring out of the spring to a dimension which is wider than the hole through which the spring passes in the comber board, permits the spring to bear against the undersurface of the comber board without being pulled through the hole. At the same time, the flared nature of the spring connection at that point causes the spring to be more reliably reinforced in its capacity of both holding-down the upper portion of the spring and acting as a resilient member in first entering into a high tension phase as the heddle is elevated by the upper portion of the Jacquard loom, and then maintaining its position as the spring causes the heddle to return to its lowermost position when the harness hook is released at the upper end of the loom.

By providing for a flared connection in the underlying spring and by locating the flared connection at a point beneath the comber board hold-down arrangement, a combination effect is obtained whereby the resilient action of the spring is enhanced and the reliability of the hold-down connection is strengthened. These features together assist in enhancing the operation of the Jacquard loom and making it a more productive and reliable device.

It is therefore a feature of an embodiment of this invention that a flared connection is utilized in the body of the spring which holds down the heddle of a Jacquard loom.

It is another feature of an embodiment of this invention that a comber board is utilized for aligning the spring in a Jacquard hold-down arrangement to provide a stable planar surface to more reliably retain the spring and thereby improve the uniformity of movement of the heddles.

Additional objects, features and advantages of the present invention will become apparent when considered in conjunction with a presently preferred, but nonetheless illustrative, embodiment of the present invention as explained in the following detailed description and as shown in the accompanying drawings, wherein:

FIG. 1 is a schematic perspective view of selected components of a Jacquard loom, showing the control strings, heddles, hold-down springs and a comber board hold-down arrangement;

FIG. 2 is a front elevational sectional view of a portion of the Jacquard loom, showing the hold-down portions of the springs and their flared connections beneath the comber board, taken along the plane 2—2 of FIG. 1 in the direction of the arrows; and FIG. 3 is an enlarged and fragmentary sectional view of the connection between the hold-down spring and the heddle, through an alignment board device, taken along the line 3—3 of FIG. 1 in the direction of the arrows.

In initially examining the overall perspective view of FIG. 1, it should be appreciated that the portions of the Jacquard loom which are illustrated in that view are predominantly schematic in nature. Thus, there is no precise showing of the normal "head" of the Jacquard loom, nor of the usual and conventional superstructure including support mechanisms, perforated card holders and transports and the entire apparatus normally utilized for raising and lowering the control strings, leading to the needles and ultimately to the heddles. In lieu of that disclosure, which represents well-known equipment and need not be discussed in any great detail in order to give those skilled in the art an understanding of this invention, the Jacquard loom 10 is shown as being provided with an overall schematic control top 12, which is intended to represent all of the aforementioned control elements of a Jacquard loom. Extending in a downward orientation from that element 12 are control strings 14, which pass through alignment board 16 via apertures 18. The control strings, which are representative of the typical strings (usually hundreds in number) in a Jacquard loom, are next connected in their downward travel to heddles 20, which pass further downward through the apertures 24 of alignment member 22, into the next area of the loom.

It is in this area where the heedles 20 are provided with their active eyelets 20A, which serve the purpose of elevating and then lowering particular warp yarns such as Y (illustratively shown through one of the heddle eyelets 20A in FIG. 1.) The heddles are coupled to hold-down springs 30 when they pass through alignment element 26 and the apertures 28 thereof. The springs 30 are in turn held by means of the upper surface member 32 of comber board hold-down arrangement 34. The springs 30 pass through the board 32 and are held immediately beneath the surface of the board 32 by the flared-out connection to be discussed below. The remainder of comber board hold-down apparatus 34 includes support layer 36 and base member 38, which are retained in place by means of upstanding vertical bolts 40 on either end of the unit.

In considering the front sectional view of FIG. 2 and the enlarged fragmentary sectional view of FIG. 3, it should be appreciated that both the heddles 20 and the springs 30 are reinforced in their connections, both to each other (between heddle and spring) and beneath the comber board 32 (for the spring 30 alone). Dealing first with the connection between the heddle and the spring, reference may be had to FIG. 3, in which the manner of connection of a typical heddle 20 to a typical hold-down spring 30 is illustrated. In passing through aperture 28 of alignment board 26, the lower end 20B of heddle 20 passes through sheath 30S which surrounds spring 30 at that location. This sheath, as is now well-known in this art, may be made of a shrink-down plastic member which collapses around the junction between the heddle 20 and spring 30 upon the application of suitable chemicals. This shrink-down relationship causes sheath 30S to virtually encapsulate the upper portion of spring 30 and the lower eyelet 20B of heddle 20, thereby providing a constricted and tightly held connection at 20C, between heddle 20 and spring 30. This provides for reliable and stable longitudinal movement of heddle 20 in the vertical direction, and the corresponding tension holding achieved by spring 30.

In order to complete the relationship of reliability and stable holding-down provided by this invention, FIG. 2 illustrates the manner by which springs 30 are held down and reliably contained within the comber board device 34. The springs 30 pass through respective apertures 32A in upper comber board planar member 32. In so doing, springs 30 occupy the normal width or diameter 30A which they usually exhibit. The relationship between the diameter of the spring at 30A and the bore 32A through board 32 is such that relatively free but not entirely unrestricted movement of spring 30 is allowed.

Beneath the lower surface of board 32, an enlarged segment 30B of spring 30 is presented, primarily to act as a stabilizing point so as to achieve the overall holding-down tension function of the spring. In order to solidify this function and to insure that the spring acts appropriately in biasing against the upward movement of heddles 20 (not shown in FIG. 2) when they are drawn upward by the Jacquard harness needles and strings, segments 30B should be held in a reliable and firm position. This is achieved by providing the flared-out connection at 30C between normal portion 30A and enlarged segment 30B of spring 30. It is, of course, noted that enlarged segment 30B occupies a diameter substantially in excess of that of aperture 32A of board 32 through which spring portion 30A passes comfortably. Accordingly, this will not only prevent segment 30B from being drawn into aperture 32A, but will also provide a reliable, fixed point, hold-down arrangement for spring 30, thereby permitting it to fulfill its resilient hold-down function.

The remaining components of hold-down box 34 include support gaskets 34A for reinforcing assistance, lateral support member 36, underlying base unit 38 and vertical support bolts 40. These devices all cooperate to provide for a stable foundation for hold-down comber board 34, and for the proper functioning of springs 30 in reliably holding the heddles in place during their vertical transitions based upon the commands received from the Jacquard harness members.

It will therefore be appreciated that through the use of the enlarged or flared connection between two component portions of the hold-down springs, and the interaction of the flared connection and the comber board hold-down itself, a structure has been provided to strengthen the connection by which the springs are held down and to also reliably align the springs' action in their vertical movement so as to improve the consistency of operation and performance of the Jacquard loom to which these devices are attached.

It will be understood that while the invention has been described with reference to a particular embodiment, it is to be understood that these embodiments are merely illustrative of the application of the principles of the invention. Numerous modifications may be made therein and other arrangements may be devised without departing from the spirit and scope of the invention.

What is claimed is:

1. In a Jacquard loom for producing woven patterns in fabric by selectively positioning a first group of yarn elements relative to a second group of yarn elements, under the control of predetermined program means, including a plurality of heddles linked individually to corresponding ones of said first group of yarn elements, spring means for exerting downward tension on each of said heddles, and alignment means including a plurality of apertures through which said spring means extend at their lower ends regions, said alignment means defining a retaining position for said spring means;

the improvement comprising that:

(a) each said spring means is a unitary spring having a plurality of interconnected helical coils, and (b) each said spring includes a first segment connected to a respective one of said heddles and of a diameter to pass through a respective one of said apertures, and a second segment located below said alignment means and of a larger diameter then said first segment, said second segment being in substantial contact with a portion of said alignment means and incapable of passing through said aperture.

2. A Jacquard loom in accordance with claim 1 wherein said second segment of each said spring is substantially frusto-conically-shaped and includes a group of said coils which increase in diameter from that of said first segment of said spring.

3. A Jacquard loom in accordance with claim 1 wherein said alignment means comprises a substantially planar element having said apertures therethrough, and wherein said planar element includes at least a lower surface corresponding to said portion of said alignment means.

4. A Jacquard loom in accordance with claim 3 wherein said lower surface of said planar element defines a bearing surface for each said spring at the junction between said first and second segments thereof, the engagement of said bearing surface by said second segment of each said spring serving to retain the same substantially at its original position when said heddles are displaced upwardly while under the tension of said springs.

5. A Jacquard loom in accordance with claim 4 including control means for individually controlling the movement of each of said heddles, and wherein said planar element comprises a comber board with said plurality of apertures aligned with corresponding elements in said control means.

* * * * *